United States Patent [19]

Obadia

[11] Patent Number: 4,796,769

[45] Date of Patent: Jan. 10, 1989

[54] TAMPER-PROOF POURER AND STOPPER CAP ASSEMBLY

[75] Inventor: Jacques Obadia, Paris, France

[73] Assignee: RICAL S.A., Longvic, France

[21] Appl. No.: 64,561

[22] Filed: Jun. 22, 1987

[30] Foreign Application Priority Data

Jun. 26, 1986 [FR] France ..... 86 09302

[51] Int. Cl.[4] ..... B65D 41/48

[52] U.S. Cl. ..... 215/232; 215/256; 215/307; 222/541; 222/546

[58] Field of Search ..... 215/256, 232, 307; 222/541, 546

[56] References Cited

U.S. PATENT DOCUMENTS 3,341,046 9/1967 Bereziat et al. ..... 222/546 X
4,387,818 6/1983 Conti ..... 215/256

FOREIGN PATENT DOCUMENTS 1462827 11/1966 France .
2501637 9/1982 France .
2524427 10/1983 France .

*Primary Examiner*—Donald F. Norton
*Attorney, Agent, or Firm*—Owen, Wickersham & Erickson

[57] ABSTRACT

Pourer and stopper cap assembly comprising a guarantee strip (23) produced in a single, piece with the pourer (1). The guarantee strip (23) extends from the pourer (1) over the entire height of the cap (2) and, at its free upper end, has a turned-in portion (29) which covers the outer upper edge of the cap (2).

The invention is used for the packaging of liquids, especially for long-term storage.

17 Claims, 1 Drawing Sheet

TAMPER-PROOF POURER AND STOPPER CAP ASSEMBLY

The present invention relates to a pourer and stopper cap assembly in plastic for bottles or similar receptacles, comprising a pourer with means for fastening it to a bottle neck or a similar receptacle orifice, a cap attached removably to the pourer so as to cover and close off the latter, and tamper-proof means comprising a guarantee strip connected to the pourer in a tear-off manner and interacting with the cap so as to prevent the cap from being removed without the guarantee strip previously being torn off.

On known pourer and stopper cap assemblies of this type, the cap is retained on the pourer by snapping or by screwing, and the guarantee strip extends from the pourer upwards over a greater or lesser portion of the height of the cap. The purpose of this guarantee strip is as far as possible to prevent a grip on the cap and consequently the possibility of removing the cap from the pourer without tearing off or damaging this strip. These known assemblies are not always sufficiently tamper-proof, especially when the cap is retained on the pourer not by screwing or by snapping, but simply as a result of the clamping effect exerted on the pouring spout by an inner sealing skirt formed on the cap so as to interact with the pouring spout by means of a force fit.

The subject of the present invention is a pourer and stopper cap assembly offering improved tamper-proofing, without an increase in the cost price of the assembly.

On the pourer and stopper cap assembly according to the invention, the guarantee strip connected to the pourer in a tear-off manner extends from the pourer over the entire height of the cap and, at its free end, has an annular turned-in portion which covers the upper outer edge of the cap.

The guarantee strip of the assembly according to the invention therefore surrounds the cap not only over its entire height, but also in the region of its upper edge, so that it is impossible to grasp the cap as long as the guarantee strip has not been torn off.

Preferably, the cap has, on its upper face, an annular shoulder, against which bears the end of the said turned-in portion of the guarantee strip.

This reduces the possibilities of tampering even further, in that the turned-in portion of the guarantee strip does not project above the top of the cap, so that it is impossible, without damaging the guarantee strip, to insert, for example, a pointed object between the cap and the guarantee strip at the location of the turned-in portion of the latter.

To make it simpler to produce the pourer and the guarantee strip in one piece by moulding, it is advantageous if the turned-in portion of the guarantee strip is interrupted by notches distributed over the periphery. These notches give the turned-in portion of the guarantee strip sufficient elasticity to allow this turned-in portion to be removed from the mould by means of elastic deformation.

Both to improve the tamper-proofing and to improve the gas tightness (penetration of air in hot packaging and the escape of inert gas in packaging under an inert-gas atmosphere) before the guarantee strip is torn off, the turnedin portion of the guarantee strip can be welded to the cap.

Still in order to improve sealing, it is advantageous if the guarantee strip is connected to the pourer by means of a joining line continuous over the entire periphery and by means of reinforced connecting bridges distributed over the periphery.

According to an advantageous embodiment, the assembly according to the invention can have a film extending over the upper face of the cap and welded to the turned-in portion of the guarantee strip over the entire periphery.

Such a film consisting, for example, of aluminium or of other materials slows down even further the possible gas exchanges between the inside and the outside, increases protection against ultraviolet rays, this being desirable in the packaging of some sensitive products, and ensures extra protection, that is to say an improvement in tamper-proofing, sought after particularly in the packaging of pharmaceutical products.

To make it easier to connect, before the pourer and stopper cap assembly are fitted to a bottle neck, the capsule on the one hand and the pourer, together with the guarantee strip, on the other hand, after the separate production of these two elements, it is advantageous if the cap has an outer shape in the form of a cone converging from the upper face towards the lower edge of the cap. This cone shape makes it simpler to insert the cap inside the guarantee strip from the side on which the turned-in portion of the latter is located.

In order also to improve the tamper-proofing of the pourer and stopper cap assembly in the region of the connection between the pourer and the bottle neck, the pourer having at least one annular skirt surrounding the neck on the outside and equipped with an inner bead for fastening in an outer groove of the neck, the said skirt has an extension which extends downwards beyond the fastening bead, its lower end being brought to bear on an outer shoulder of the neck. The said extension has several zones of reduced thickness in the form of vertical channels.

Thus, in any attempt to remove the pourer from the neck by force, for example by inserting a pointed object between the said shoulder of the neck and the lower end of the extension of the outer skirt of the pourer, the zones of this extension which are of reduced thickness and therefore brittle break and thus indicate that tampering has occurred.

To make it easier to fit the pourer and stopper cap assembly on the bottle neck, it is advantageous if the outer skirt of the pourer has on the inside, between the said zones of reduced thickness, slopes between the said extension and the fastening bead.

With reference to the accompanying drawing, an illustrative and non-limiting embodiment of a pourer and stopper cap assembly according to the invention will be described below in more detail; in the drawing.

Figure 1:
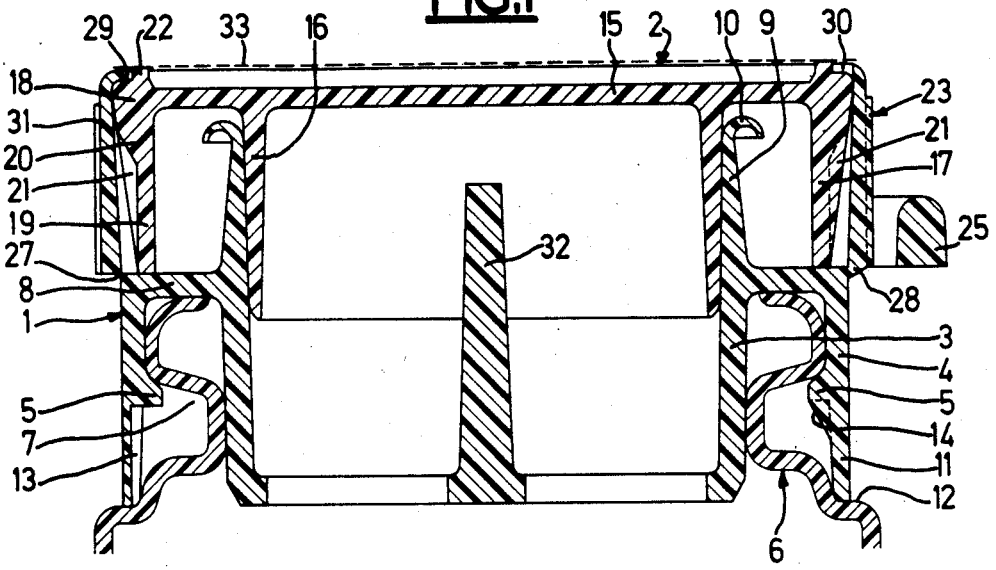
FIG. 1 is a section according to I—I of FIG. 2 of a pourer and stopper cap assembly according to the invention.

As illustrated in the drawings, the pourer and stopper cap assembly comprises a pourer 1 and a stopper cap 2, both made of plastic, for example polyethylene.

The pourer 1 comprises two concentric skirts 3 and 4 of general cylindrical shape, namely a substantially smooth inner skirt 3 and an outer skirt 4 having an inner annular bead 5 approximately at mid-height. The pourer 1 is fitted onto the neck 6 of a bottle, in such a way that the inner skirt 3 penetrates inside the neck and the outer skirt 4 surrounds the neck externally, the bead 5 snapping into an outer groove 7 in the neck.

The two skirts 3 and 4 are connected by means of an annular connecting part 8. The inner skirt 3 is extended upwards beyond the connecting part 8, in the form of a pouring spout 9, the upper annular edge 10 of which is curved outwards.

Underneath the fastening bead 5, the outer skirt 4 has an extension 11, the lower end of which bears against an outer shoulder 12 of the neck 6. This extension 11 has several zones 13 of reduced thickness distributed over the periphery. The zones 13 of reduced thickness, only one of which can be seen in the left-hand part of FIG. 1, take the form of vertical channels in the inner face of the extension 11.

Moreover, in the right-hand part of FIG. 1, it can be seen that slopes 14 are provided on the inner face of the extension 11 between the zones 13 of reduced thick ness, underneath the fastening bead 5, to make it easier to fit the pourer 1 onto the bottle neck 6.

The cap 2 is composed of a bottom 15, from which two concentric skirts 16, 17 of substantially cylindrical general shape project downwards. The inner skirt 16 is intended to interact with the inside of the pouring spout 9 by means of a force fit, to ensure the sealed closure of the latter.

The outer skirt 17 of the cap 2 serves for gripping the cap 2 and as a stop limiting the insertion of the inner skirt 16 into the pourer 9. For this purpose, when the cap is driven home, the lower end of the outer skirt 17 bears on the connecting part 8 of the two skirts 3 and 4 of the pourer 1.

The outer skirt 17 of the cap 2 has on the inside a cylindrical shape and on the outside a general shape in the form of a truncated cone converging from the bottom 15 towards the lower edge of the skirt. As can be seen on the left-hand side of FIG. 1, the skirt 17 is composed of a thick upper part 18, a thin lower part 19 and a joining part 20 having a markedly frustoconical outer shape. A comparison between the left-hand right-hand parts of FIG. 1 shows that vertical ribs 21 distributed over the periphery join the two parts 18, 19 together on the outer face of the skirt 17 with less conicity than that of the outer surface of the intermediate part 20. These ribs 21 which form a type of knurling making it easier to grip the cap 2 give to the latter a general frustoconical outer shape.

The bottom 15 of the cap 2 carries on its upper face, at a short distance from its outer edge, an annular bead 22 which is substantially in the extension of the part 19 of the skirt 17.

A tear-off guarantee strip 23 is produced in one piece with the pourer 1. As emerges from FIG. 2, the guarantee strip 23 extends over the entire periphery of the cap 2 and has a weakening zone 24 and a tear-off tab 25 located on one side of the weakening zone 24, the free end of the tab 25 being connected to the strip 23 by means of a breakable connecting bridge 26.

The strip 23 is connected, at its lower edge, to the outer edge of the connecting part 8 of the pourer 1 by means of a thin peripheral connecting line 27 reinforced by thicker bridges 28 at several points distributed over the periphery (see the left-hand and right-hand parts of FIG. 1).

The guarantee strip 23 extends upwards from its zone (27, 28) of connection to the pourer 1 over the entire height of the cap 2 and, at its upper end, has a turned-in portion 29 which covers the outer edge of the bottom 15 of the cap 2, the free end of the turned-in portion 29 bearing against the shoulder formed by the annular rib 22 of the bottom 15 of the cap 2. The height of the rib 22 is equal to or greater than the thickness of the strip 23 at the location of the turned-in portion 29. Thus, the turned-in portion 29 is set back from the upper face of the bead 22 or at most is flush with this upper face of the bead 22.

The turned-in portion 29 of the guarantee strip 23 has several notches 30 distributed over the periphery. The purpose of the notches 30 is to give the turned-in portion 29 sufficient elasticity to allow the turned-in portion 29 to be deformed outwards when the cap 2 is driven onto the pourer 1 equipped with the guarantee strip 23. In fact, during this driving action, the turned-in portion 29 is deformed outwards by the outer skirt 17 of a general frusto-conical outer shape, the turned-in portion 29 relaxing inwards to resume the shape which can be seen in FIG. 1, that is to say to cover the outer upper edge of the cap 2 when the latter is driven home, the lower end of the skirt 19 of the cap 2 bearing against the connecting part 8 of the pourer 1.

Figure 2:
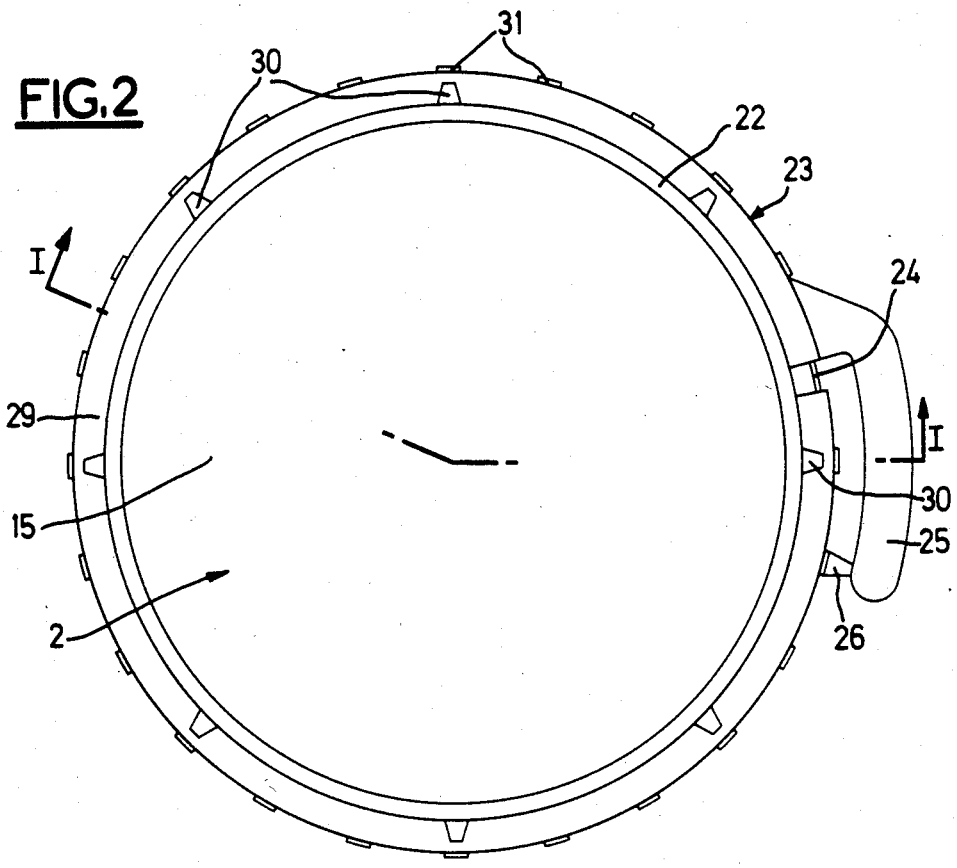
FIG. 2 is a plan view of the assembly of FIG. 1.

Finally, FIGS. 1 and 2 show that the guarantee strip 23 has outer ribs 31 which extend upwards the thick bridges 28 connecting the strip 23 to the pourer 1.

Lastly, it is appropriate to note that the pourer 1 has, on the inside of its inner skirt 3, a network of small bars connecting a central stem 32, which can be seen in FIG. 1, to the lower body of the skirt 3. The purpose of this arrangement is, on the one hand, to stabilize the flow through the pourer of the liquid packaged in the receptacle equipped with the pourer and stopper cap assembly and, on the other hand, to simplify the injection-moulding of the pourer. In fact, injection takes place via the stem 32 (sprue), and the small bars form feed ducts for the mould as a whole.

To improve the sealing of the pourer and stopper cap assembly before the guarantee strip is torn off, it is possible to connect the turned-in portion 29 of the guarantee strip 23 to the bead 22 of the cap 2 by welding, for example by means of a heated tool.

Furthermore, as indicated by dashes in FIG. 1, a sheet 33 consisting, for example, of aluminium or plastic can be attached to the top of the cap and welded to the rim 29.

On the pourer and stopper cap assembly, any attempt at tampering before the guarantee strip is torn off, whether at the connection between the pourer 1 and bottle neck 6 or at the connection between the cap 2 and guarantee strip 3, causes damage visible to the naked eye (breaking of the lower part 11 of the outer skirt 4 of the pourer 1 at the location of the weakening zones 13, breaking of the guarantee strip at the location of the weakening zone 27).

Moreover, the pourer and stopper cap assembly according to the invention ensures perfect sealing and, in particular, prevents any passage of gas (inflow of air or outflow of buffer gas), thus resulting in a lengthening of the possible storage life of the packaged product, when, in addition to the sealed connection between the guarantee strip and the pourer, a sealed connection is also made between the guarantee strip and the cap (by welding the turned-in portion 29 to the cap 15 and/or by the use of an additional sheet welded to the turned-in portion of the guarantee strip).

I claim:

1. A pourer and stopper cap assembly molded from plastic material for bottles and similar receptacles, including in combination a pourer for fastening to a bottle neck or a similar receptacle orifice, said pourer comprising an inner annular skirt adapted for fitting inside a said neck, an outer annular skirt adapted for fitting outside said neck, and an annular connecting portion joining said two skirts at their upper end, said connecting portion having a spout projecting upwardly from said connecting portion, said spout being substantially an extension of said inner skirt, and a cap comprising an upper circular end wall and, projecting downwardly from said end wall, an inner annular skirt and an outer annular skirt at the outer edge of said end wall so that when said cap is fitted on said pourer, said cap's inner skirt is forced into said pourer spout and said cap's outer skirt surrounds said spout with its lower end bearing against said connecting portion of said pourer, said end wall of said cap having on its upper face an annular shoulder offset inwardly from the outer edge of said end wall, said pourer also having an annular tear-off guarantee strip integrally molded with said pourer, said strip being connected by a peripheral weakening line to said connecting portion of said pourer, said strip extending from said connecting portion upwardly around said cap's outer skirt over the entire height of said cap's outer skirt, and being provided at its upper end, when molded, with an annular turned-in portion which surrounds said outer edge of said end wall of said cap and bears against said annular shoulder of said end wall, the height of said shoulder being at least equal to the thickness of said guarantee strip at said turned-in portion.

2. Assembly according to claim 1, wherein the said turned-in portion is interrupted by notches distributed over the periphery.

3. Assembly according to claim 1, wherein the pourer, together with the guarantee strip and the cap, are produced from thermoplastic material, and said turned-in portion of the guarantee strip is welded to the cap.

4. Assembly according to claim 3, wherein a film extending over the upper face of the cap is welded to the turned-in portion of the guarantee strip.

5. Assembly according to claim 1, wherein said guarantee strip is connected to the pourer by means of a continuous connecting line and by means of reinforcing bridges distributed over the periphery.

6. Assembly according to claim 1, wherein the cap has a general outer shape in the form of a cone converging from the upper face towards the edge of the cap.

7. Assembly according to claim 1, wherein the pourer's outer annular skirt is equipped with an inner bead for fastening in an outer groove of the neck, the said skirt having an extension downwards beyond the said bead, so as to bear at its lower end on an outer shoulder of the neck, said extension having seveal zones of reduced thickness in the form of vertical channels and distributed over the periphery.

8. Assembly according to claim 7, wherein the outer skirt of the pourer has, between the said zones of reduced thickness, inner slopes between the said extension and the said bead.

9. The assembly according to claim 1, wherein said shoulder is defined by an annular rib on said end wall.

10. A pourer and stopper cap assembly molded from plastic material for bottles and similar receptacles, including in combination a pourer for fastening to a bottle neck or a similar receptacle orifice, said pourer comprising an inner annular skirt adapted for fitting inside a said neck, an outer annular skirt adapted for fitting outside said neck, and an annular connecting portion joining said two skirts at their upper end, said inner skirt having a pourer spout projecting upward therefrom, and said pourer spout being substantially an extension of said inner skirt, a cap comprising an upper circular end wall and, projecting downwardly from said end wall, an inner annular skirt and an outer annular skirt at the outer edge of said end wall, so that when said cap is fitted on said pourer, said cap's inner skirt is forced into said pourer spout and said cap's outer skirt surrounds said spout with its lower end bearing against said connecting portion of said pourer, said end wall of said cap having on its upper face an annular shoulder offset inwardly from the outer edge of said end wall, said pourer having an annular tear-off guarantee strip integrally molded with said pourer, said strip being connected by a peripheral weakening line to said connecting portion of said pourer, said strip extending from said connecting portion upwardly around said cap's outer skirt over the entire height of said cap's outer skirt, and being provided at its upper end, when molded, with an annular turned-in portion which surrounds said outer edge of said end wall of said cap and bears against said annular shoulder of said end wall, the height of said shoulder being at least equal to the thickness of said guarantee strip at said turned-in portion, said turned-in portion having a periphery with a series of notches distributed evenly along said periphery.

11. Assembly according to claim 10, wherein the pourer, together with the guarantee strip and the cap, are produced from thermoplastic material, and said turned-in portion of the guarantee strip is welded to the cap.

12. Assembly according to claim 11, wherein a film extending over the upper face of the cap is welded to the turned-in portion of the guarantee strip.

13. Assembly according to claim 10, wherein said guarantee strip is connected to the pourer by means of a continuous connecting line and by means of reinforcing bridges distributed over the periphery.

14. Assembly according to claim 10 wherein said shoulder is defined by an annular rib on said end wall.

15. Assembly according to claim 10, wherein the cap has a general outer shape in the form of a cone converging from the upper face towards the edge of the cap.

16. Assembly according to claim 15, wherein the outer skirt of the pourer has, between said zones of reduced thickness, inner slopes between said extension and said bead.

17. Assembly according to claim 10, wherein the pourer's outer annular skirt is equipped with an inner bead for fastening in an outer groove of the neck, the said skirt having an extension downwards beyond the said bead, so as to bear at its lower end on an outer shoulder of the neck, said extension having several zones of reduced thickness in the form of vertical channels and distributed over the periphery.

* * * * *